United States Patent [19]

Skogward

[11] Patent Number: 4,754,721

[45] Date of Patent: Jul. 5, 1988

[54] ARRANGEMENT OF A HAND WHEEL ON A SEWING MACHINE

[75] Inventor: Kenneth O. E. Skogward, Huskvarna, Sweden

[73] Assignee: Husqvarna Aktiebolag, Sweden

[21] Appl. No.: 22,130

[22] Filed: Mar. 5, 1987

[30] Foreign Application Priority Data

Mar. 11, 1986 [SE] Sweden ..... 8601131

[51] Int. Cl.[4] ..... D05B 69/28

[52] U.S. Cl. ..... 112/275

[58] Field of Search ..... 112/275, 277, 121.11, 112/283, 274

[56] References Cited

U.S. PATENT DOCUMENTS 4,254,724 3/1981 Conrads ..... 112/277 X
4,351,254 9/1982 Brown ..... 112/275 X
4,438,718 3/1984 Hanyu ..... 112/274

FOREIGN PATENT DOCUMENTS 59-34391 8/1984 Japan ..... 112/277

*Primary Examiner*—Peter Nerbun
*Attorney, Agent, or Firm*—Alfred E. Miller

[57] ABSTRACT

The invention makes it possible to rotate an arm shaft of a sewing machine without a mechanical clutch between the hand wheel and the arm shaft. The position of the hand wheel which previously was very dependent on the mechanical system, can now be chosen so that the best possible ergonometry is obtained. Output of an electronic sensor of the rotation of the hand wheel and another sensor of the movement of the arm shaft are compared in an electronic unit, and as long as there is a difference in the outputs of the sensors the electronic unit will cause driving of the sewing machine motor so that the difference will be zero. The movement of the hand wheel is thus repeated on the arm shaft.

5 Claims, 2 Drawing Sheets

ARRANGEMENT OF A HAND WHEEL ON A SEWING MACHINE

The present invention relates to an arrangement of a hand wheel on a sewing machine, preferably an electronic machine wherein control of functional units in the machine is effected by a pulse generator in the driving system, e.g. on the crankshaft.

In the past the hand wheel has always been secured on the upper arm shaft of the machine outside the end surface at the post. In modern machines the hand wheel is used very seldom, since the motor drives the machine slowly to desired needle positions or at taking up the bobbin thread. However, it can be necessary during maintenance and checking to rotate the machine shaft slowly to and fro which is effected most simply by means of a hand wheel, so it cannot be totally omitted. From the operator's point of view the wheel can be positioned on, for instance, the front side of the machine to provide simpler handling as it then is among the other input and control members of the machine. Another advantage from an ergonomic point of view is that the wheel now controls the machine via the electronic system, not as previously via a mechanical one. This means that the power required on the wheel to rotate the same now can be chosen in such a way that the operator finds the handling of the machine simple.

A problem arising from such an optional position of the hand wheel has, according to the invention, been solved in that the wheel is journalled on its shaft and provided with a code disc rotating in synchronism with the wheel. The code disc is so designed that it forms a two-bit Gray-code. Its pulses are supplied to an electronic unit which, in dependence of the direction, steps a counter. The arm shaft of the sewing machine is provided with a code disc equivalent to that of the hand wheel, and the pulses from the disc are supplied in the same way to the electronic unit and step another counter. The driving motor of the sewing machine is also connected to the unit in such a way that speed and direction of the motor can be controlled by the unit. If someone rotates the hand wheel, its counter will count in dependence on the direction of rotation. The count of this counter is compared with the count of the counter of the arm shaft and, as long as there is a difference between the counts of these counters, the electronic unit causes driving of the sewing machine motor so that the difference in the count goes on zero. This means that the arm shaft will always follow the rotation of the hand wheel. The counters are reset to zero when the foot control is actuated and remain zero as long as it is actuated. This means that the sewing machine does not react to movements of the hand wheel during periods when the foot control is actuated.

Figure 5:
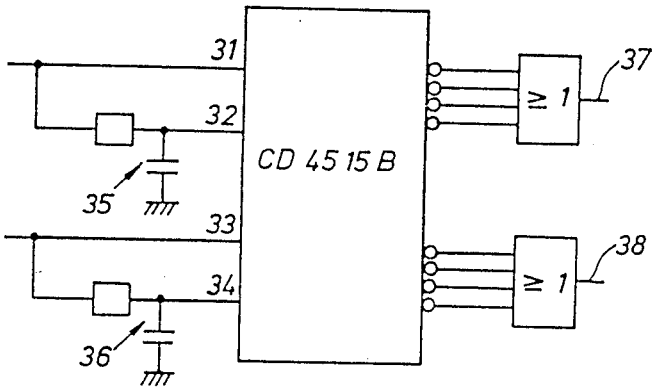

An embodiment of the invention will now be described in the following with reference to the accompanying drawings which show in FIG. 1 a cross sectional view of a hand wheel, FIG. 2 a plan view of the same hand wheel in the direction shown by the arrows in FIG. 1, FIG. 3 a portion of the arm shaft with a pulse generator in a longitudinal section, FIG. 4 a block diagram of the electronic system of the arrangement, FIG. 5 a module in the electronic system.

Figure 1:
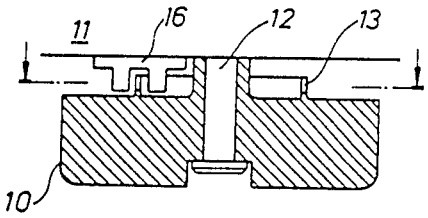
Figure 2:
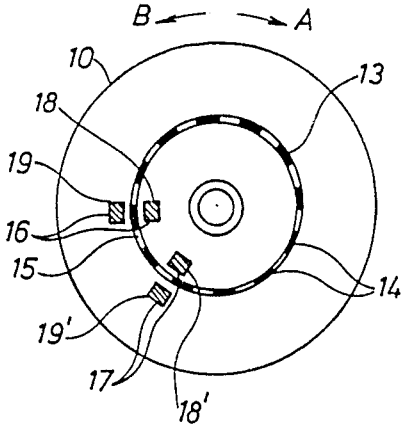

A hand wheel 10 according to FIGS. 1 and 2 is journalled on the shaft 12 projecting on a body, panel or the like 11 and has a circular rim 13 protuding on its rear surface consisting of teeth 14 and gaps 15 between the teeth. A pair of opto-sensors 16, 17 are secured on the body straddling above the rim 30 so that a light source 18, 18' is positioned on one side and a photo transistor 19, 19' on the other. The teeth 14 screen the light and pass pulsing light to the transistors when the wheel rotates. The arrangement of an opto-sensor device at a rim of teeth and gaps is previously described in the Swedish Patent Spec. No. SE-P 8004226-0 and corresponding U.S. Pat. No. 4,398,348.

The provision of two opto-sensors 16, 17 is necessary since the direction of rotation of the wheel should be indicated. The indication of direction is expressed in the consequence of the electric pulses from the transistor 19, 19' which have output wires 20, 21 to a decoder 22. The directions of rotation are shown by arrows A and B in FIG. 2. The relation between the A and the output signals as well as the direction B and the other output signals is described in the above patent, which is incorporated by reference herein.

The generic term of a binary code in which the bits change character at separate times is Gray-code, and the direction responsive two-bit code obtained on the wires 20, 21 is such a Gray-code.

Figure 3:
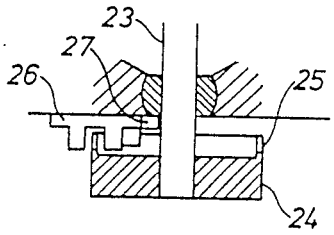

The pulse generator shown in FIG. 3 on an arm shaft 23 has identically equal components, i.e. a code disc 24 with a rim 25 and two opto-sensors 26,27 with output wires 28, 29 to a decoder 30.

Figure 4:
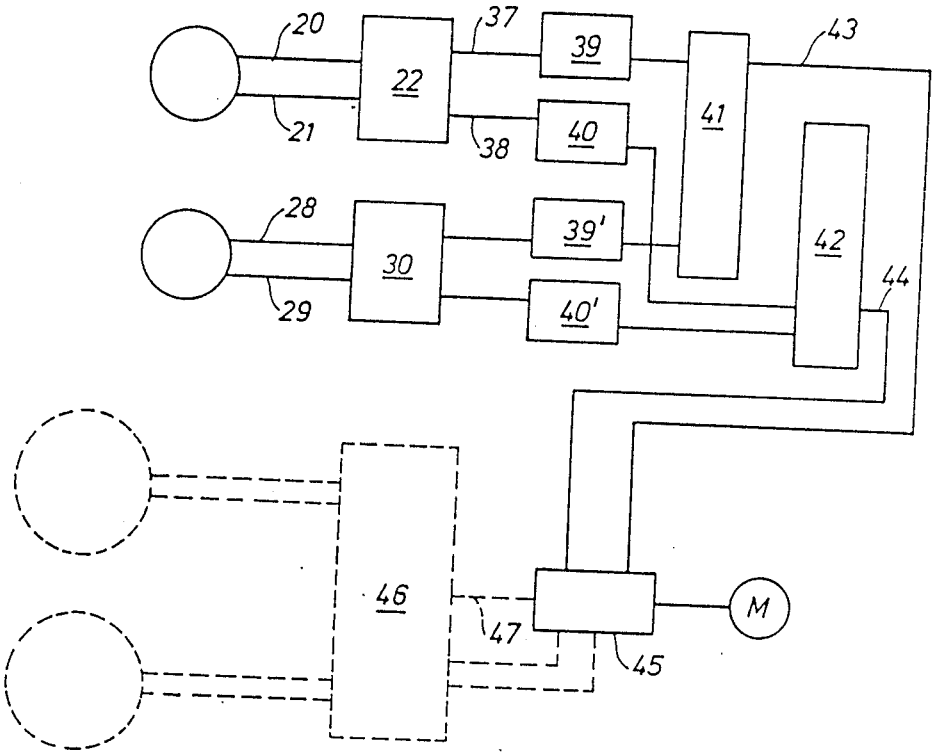

For the description of the mode of operation of the device reference is made to FIG. 4. From the opto-sensors of the hand wheel and the code disc emanate the wires 20, 21 and 28, 29, respectively, to supply the decoders 22 and 30. The main part is comprised of a "1 of 16" decoder which in known TTL-technics may be a standard circuit number CD 4515B (FIG. 5). The signals are supplied by the opto-sensors on the inputs 31, 32, 33, 34 of which the inputs 32, 34 get the signals via delay circuits 35, 36, so that input codes with respect to phase shift between the transistors are fed simultaneously on the inputs. These then receive bits in said Gray-code which is unique and determined by the present direction of rotation. In direction A the decoder supplies pulses on its output 37, and in direction B the pulses are supplied on output 38. From these outputs the pulses pass to binary counters 39, 40 of which the counter 39 counts upwards on rotation according to A and 40 on rotation according to B. Similarly to FIG. 3 the code disc sensor has identically equal components which in FIGS. 4 and 5 are marked with on the corresponding number.

The binary codes from 39, 39' are fed into a comparator 41 and the codes from 40, 40' into another comparator 42. As soon as the input codes on the comparators are different a signal appears on an output 43, 44, respectively. Thus, a signal on 43 means that the hand wheel rotates in direction A, and a signal on 44 means that it moves in direction B. The signals on 43 and 44, respecitvely, are passed to a control circuit of the sewing machine motor provided with driving circuits which cause the motor to drive forwards or backwards in dependence of the signals from 43, 44. The arm shaft 23 of the machine will then follow the movement of the hand wheel, whatever direction the movement has, and when the comparator senses the same codes on the inputs the signal from the comparator ceases causing a stop of the motor. The shaft has then made the same movement as the hand wheel, despite the fact that it is mechanically separated from it.

The embodiment now described is based on several modules connected to each other, but in practice a microprocessor 46 should be a better solution, since an improvement of the device by introducing a speed control of the motor then is possible, so that also rapid movements of the hand wheel are immediately repeated on the arm shaft. An embodiment with a processor is shown in dashed lines in FIG. 4, where the line 47 represents said speed control.

I claim:

1. In a sewing machine arrangement including a rotatably journalled hand wheel, a driving motor and a motor control circuit which controls driving of the sewing machine in dependence on control signals applied thereto, the improvement comprising a first angle of rotation meter comprising a first generator for supplying pulses corresponding to predetermined angles of rotation of a shaft in the machine, and a first counter connected to the generator for counting the pulses, a second angle of rotation meter on said rotatably journalled hand wheel comprising a second generator for supplying pulses corresponding to predetermined angles of rotation of said hand wheel and a second counter for counting said last mentioned pulses, and a comparator for comparing the counts of pulses of the first and second counters, and means responsive to a difference between the counts of said first and second counters for applying signals to said motor control circuit for driving the motor until said difference has ceased.

2. Arrangement according to claim 1, wherein the counters, the comparator and the signal generator comprise parts of a micro-processor in the sewing machine.

3. Arrangement according to claim 1, wherein said first and second generators are comprised of first and second opto-sensors respectively cooperating with rotating circular code discs.

4. Arrangement according to claim 1, wherein the counters have inputs connected to a current control circuit of the machine, said current control circuit outputting a signal to said counters for zero adjustment thereof when the current control circuit is actuated and for disconnection of the counters from the current control circuit during periods when the control is not actuated.

5. Arrangement according to claim 3, wherein the first and second opto-sensors output a two-bits Gray-code including an indication of the turning direction of the shaft and wheel, respectively, and wherein the pulses for angle of rotation are separated as a function of the turning direction and are supplied to separate counting portions of said first counter and second counter, in dependence upon said turning direction, the separate portions of said first and second counters being connected to the separate portions of said comparator for separately comparing counts corresponding to the turning directions.

* * * * *